US006520609B1

(12) United States Patent
Beauregard et al.

(10) Patent No.: US 6,520,609 B1
(45) Date of Patent: Feb. 18, 2003

(54) TOOL-HOLDING STOOL DEVICE

(76) Inventors: Alan Beauregard, 13 Williams Dr., Hudson, NH (US) 03051; Darlene Beauregard, 13 Williams Dr., Hudson, NH (US) 03051

( * ) Notice: Subject to any disclaimer, the term of this patent is extended or adjusted under 35 U.S.C. 154(b) by 0 days.

(21) Appl. No.: 09/966,377

(22) Filed: Sep. 28, 2001

(51) Int. Cl.[7] ..... A47B 83/00
(52) U.S. Cl. ..... 312/235.2
(58) Field of Search ..... 312/235.2, 235.5, 312/249.1, 249.8, 249.13, 902, 209; 297/188.01; 280/47.19, 47.25, 47.26, 47.35, 47.4, 79.2

(56) References Cited

U.S. PATENT DOCUMENTS

| | | | | | |
|---|---|---|---|---|---|
| 1,341,596 | A | * | 5/1920 | Shaw | 312/235.2 |
| 2,628,146 | A | * | 2/1953 | De Rennaux | 312/235.5 |
| 3,099,398 | A | | 7/1963 | Croteau | |
| 3,966,286 | A | * | 6/1976 | Groseclose | 312/249.8 X |
| D276,861 | S | | 12/1984 | Keddie | |
| 4,744,613 | A | | 5/1988 | Brantingham et al. | |
| 4,826,007 | A | | 5/1989 | Skeie | |
| 4,832,355 | A | | 5/1989 | Hung | |
| 5,302,014 | A | * | 4/1994 | Hobson | 312/209 X |
| 5,344,339 | A | | 9/1994 | Cheslock | |
| 5,551,773 | A | * | 9/1996 | Cottrell | 312/249.8 |
| 5,564,803 | A | * | 10/1996 | McDonald et al. | 312/249.11 X |
| 5,853,180 | A | * | 12/1998 | Taylor | 280/47.35 X |
| 6,010,187 | A | * | 1/2000 | Dallas et al. | 312/235.2 X |
| 6,076,298 | A | * | 6/2000 | Teel | 43/54.1 |
| 6,131,925 | A | * | 10/2000 | Weldon | 280/47.25 X |

FOREIGN PATENT DOCUMENTS

| | | | | |
|---|---|---|---|---|
| GB | 713047 | * | 8/1954 | 312/235.2 |

* cited by examiner

*Primary Examiner*—James O. Hansen

(57) ABSTRACT

A tool-holding stool device for providing ready access to tools for a handyman using a stool. The tool-holding stool device includes a seat/tool-holding member including a top wall and also including a seat portion and a tool support portion integrally connected to the seat portion; and also includes tray members being attached to the seat/tool-holding member; and further includes leg members being attached to the seat/tool-holding member; and also includes wheel assemblies being attached to the leg members.

7 Claims, 2 Drawing Sheets

TOOL-HOLDING STOOL DEVICE

BACKGROUND OF THE INVENTION

1. Field of the Invention

The present invention relates to tool-holding stools and more particularly pertains to a new tool-holding stool device for providing ready access to tools for a handyman using a stool.

2. Description of the Prior Art

The use of tool-holding stools is known in the prior art. More specifically, tool-holding stools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,099,398; U.S. Pat. No. 4,744,613; U.S. Pat. No. 5,344,339; U.S. Pat. No. 4,826,007; U.S. Pat. No. 4,832,355; and U.S. Pat. No. Des. 276,861.

While these devices fulfill their respective, particular objectives and requirements, the aforementioned patents do not disclose a new tool-holding stool device. The inventive device includes a seat/tool-holding member including a top wall and also including a seat portion and a tool support portion integrally connected to the seat portion; and also includes tray members being attached to the seat/tool-holding member; and further includes leg members being attached to the seat/tool-holding member; and also includes wheel assemblies being attached to the leg members.

In these respects, the tool-holding stool device according to the present invention substantially departs from the conventional concepts and designs of the prior art, and in so doing provides an apparatus primarily developed for the purpose of providing ready access to tools for a handyman using a stool.

SUMMARY OF THE INVENTION

In view of the foregoing disadvantages inherent in the known types of tool-holding stools now present in the prior art, the present invention provides a new tool-holding stool device construction wherein the same can be utilized for providing ready access to tools for a handyman using a stool.

The general purpose of the present invention, which will be described subsequently in greater detail, is to provide a new tool-holding stool device which has many of the advantages of the tool-holding stools mentioned heretofore and many novel features that result in a new tool-holding stool device which is not anticipated, rendered obvious, suggested, or even implied by any of the prior art tool-holding stools, either alone or in any combination thereof.

To attain this, the present invention generally comprises a seat/tool-holding member including a top wall and also including a seat portion and a tool support portion integrally connected to the seat portion; and also includes tray members being attached to the seat/tool-holding member; and further includes leg members being attached to-the seat/tool-holding member; and also includes wheel assemblies being attached to the leg members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tool-holding stool device which has many of the advantages of the tool-holding stools mentioned heretofore and many novel features that result in a new tool-holding stool device which is not anticipated, rendered obvious, suggested, or even implied by any of the prior art tool-holding stools, either alone or in any combination thereof.

It is another object of the present invention to provide a new tool-holding stool device which may be easily and efficiently manufactured and marketed.

It is a further object of the present invention to provide a new tool-holding stool device which is of a durable and reliable construction.

An even further object of the present invention is to provide a new tool-holding stool device which is susceptible of a low cost of manufacture with regard to both materials and labor, and which accordingly is then susceptible of low prices of sale to the consuming public, thereby making such tool-holding stool device economically available to the buying public.

Still yet another object-of the present invention is to provide a new tool-holding stool device which provides in the apparatuses and methods of the, prior art some of the advantages thereof, while simultaneously overcoming some-of the disadvantages normally associated therewith.

Still another object of the present invention is to provide a new tool-holding ready access to tools for a handyman using a stool.

Yet another object of the present invention is to provide a new tool-holding stool device which includes a seat/tool-holding member including a top wall and also including a seat portion and a tool support portion integrally connected to the seat portion; and also includes tray members being attached to the seat/tool-holding member; and further includes leg members being attached to the seat/tool-holding member; and also includes wheel assemblies being attached to the leg members.

Still yet another object of the present invention is to provide a new tool-holding stool device that is easy and convenient to use.

Even still another object of the present invention is to provide a new tool-holding stool device that organizes and prevents loss of tools for the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
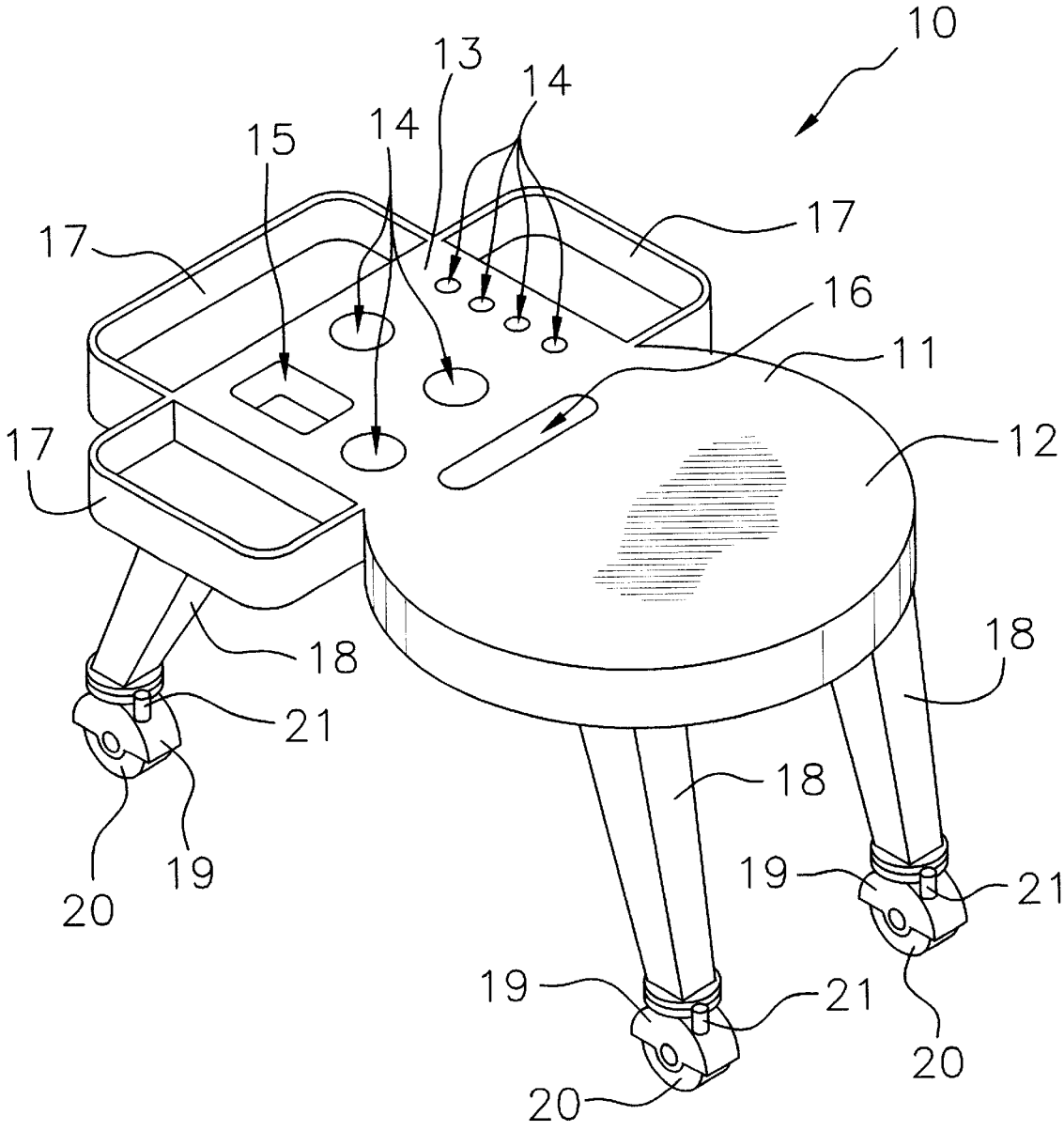
FIG. 1 is a top perspective view of a new tool-holding stool device according to the present invention.
Figure 2:
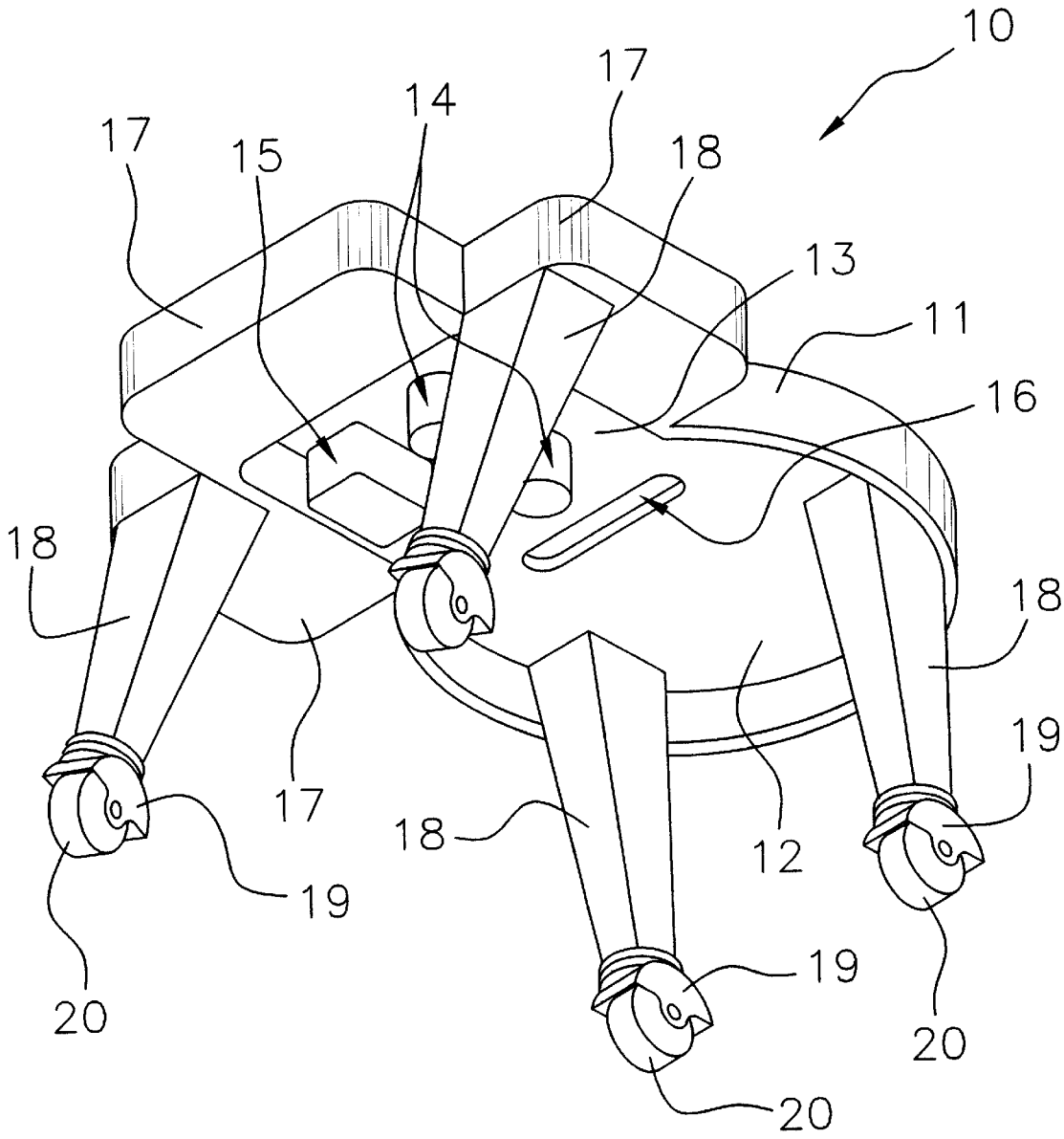
FIG. 2 is a bottom perspective view of the present invention.

With reference now to the drawings, and in particular to FIGS. 1 through 2 thereof, a new tool-holding stool device embodying the principles and concept's of the present invention and generally designated by the reference numeral 10 will be described.

As best illustrated in FIG. 1 through 2, the tool-holding stool device 10 generally comprises a seat/tool-holding member 11 including top wall and also including a seat portion 12 and a tool support portion 13 integrally connected to the seat portion 12. The seat/tool-holding member 11 further includes a plurality of recessed areas 14,15 being spacedly disposed in the top wall of the tool support portion 13 and each of the recessed areas 14,15 having a pre-determined depth and being adapted to support a particular tool. The recessed areas 14,15 include cylindrical recessed areas 14 being adapted to support writing utensils, screwdrivers, and pliers, and also include a rectangular recessed area 15 being adapted to support a drill. The seat/tool-holding member 11 further includes an elongate slot 1.6 being disposed intermediate of the seat portion 12 and the tool support portion 13 and being disposed through the top wall for being used as a handle for carrying the tool-holding stool device 10. The seat portion 12 is generally rounded and the tool support portion 1.3 is generally rectangular. The seat/tool-holding member 11 is approximately 12 to 14 inches wide and approximately 24 inches long.

Tray members 17 are integrally attached to the seat/tool-holding member 11. The tray members 17 are integrally attached to sides of the tool support portion 13 and are adapted to hold hardware including small parts and accessories. Leg members 18 are conventionally attached to the seat/tool-holding member 11 and the tray members 17. The leg members 18 are attached to an underside of the top wall and are angled relative to the top wall for stabilizing the tool-holding-stool device 10 with the leg members 18 being approximately 12 to 18 inches long. Wheel assemblies are conventionally attached to the leg members 18. The wheel assemblies include wheel support brackets 19 being rotatably mounted to bottom ends of the leg members 18, and also include wheels 20 being rotatably and conventionally mounted to the wheel support brackets 19, and further include wheel locking members 21 being depressibly and conventionally disposed in the wheel support brackets 19 and being engagable to the wheels 20 for preventing rotation of the wheels 20.

In use, the user places one's tools in the appropriate recessed areas 14,15, and also places hardware parts and accessories in the tray members 17 for ready access when needed to do a particular job.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A tool-holding stool device comprising:

a seat/tool-holding member including a flat planar top wall forming a co-planar seat portion and a tool support portion integrally connected to said seat portion;

tray members being attached to said seat/tool-holding member;

leg members being attached to said seat/tool-holding member;

wheel assemblies being attached to said leg members;

wherein said seat/tool-holding member further includes a plurality of recessed areas being spacedly disposed in said top wall of said tool support portion and each of said recessed areas having a pre-determined depth into said top wall such that each recessed area has a top that is coplanar with said top wall, each recessed area being adapted to support a particular tool such that lateral movement of the particular tool is prevented;

wherein said recessed areas include cylindrical recessed areas being adapted to support writing utensils, screwdrivers, and pliers, and also include a rectangular recessed area being adapted to support a drill; and wherein said seat/tool-holding member further includes an elongate slot being disposed between said seat portion and said tool support portion, said elongate slot being positioned to extend through a middle of said top wall to define said seat portion being on a first side of said elongate slot and said tool support portion being on a second side of said elongate slot, said elongate slot being disposed through said top wall for being used as a handle for carrying said tool-holding stool device.

2. A tool-holding stool device as described in claim 1, wherein said seat portion is generally rounded and said tool support portion is generally rectangular.

3. A tool-holding stool device as described in claim 1, wherein said tray members are integrally attached to sides of said tool support portion and are adapted to hold hardware including small parts and accessories.

4. A tool-holding stool device as described in claim 1, wherein said leg members are attached to an underside of said top wall and are angled relative to said top wall for stabilizing said tool-holding stool device.

5. A tool-holding stool device as described in claim 1, wherein said wheel assemblies includes wheel support brackets being rotatably mounted to bottom ends of said leg members, and also includes wheels being rotatably mounted to said wheel support brackets, and further includes wheel locking members being depressibly disposed in said wheel support brackets and being engagable to said wheels for preventing rotation of said wheels.

6. A tool-holding stool device comprising:

a seat/tool-holding member including a top wall and also including a seat portion and a tool support portion integrally connected to said seat portion said seat/tool-holding member further including a plurality of recessed areas being spacedly disposed in said top wall of said tool support portion and each of said recessed areas having a pre-determined depth and being adapted to support a particular tool, said recessed areas including cylindrical recessed areas being adapted to support writing utensils, screwdrivers, and pliers, and also including a rectangular recessed area being adapted to support a drill, said seat/tool-holding member further including an elongate slot being disposed intermediate of said seat portion and said tool support portion and being disposed through said top wall for being used as a handle for carrying said tool-holding stool device, said seat portion being generally rounded and said tool support portion being generally rectangular, said seat/tool-holding member being approximately 12 to 14 inches wide and approximately 24 inches long;

tray members being attached to said seat/tool-holding member, said tray members being integrally attached to sides of said tool support portion and being adapted to hold hardware including small parts and accessories;

leg members being attached to said seat/tool-holding member, said leg members being attached to an underside of said top wall and being angled relative to said top wall for stabilizing said tool-holding stool device, said leg members being approximately 12 to 18 inches long; and wheel assemblies being attached to said leg members, said wheel assembly including wheel support brackets being rotatably mounted to bottom ends of said leg members, and also including wheels being rotatably mounted to said wheel support brackets, and further including wheel locking members being depressibly disposed in said wheel support brackets and being engagable to said wheels for preventing rotation of said wheels.

7. A tool-holding stool device comprising:

a seat/tool-holding member including a top wall and also including a seat portion and a tool support portion connected to said seat portion, said seat/tool-holding member further including a plurality of recessed areas being spacedly disposed in said top wall of said tool support portion and each of said recessed areas having a pre-determined depth and being adapted to support a particular tool, said recessed areas including cylindrical recessed areas being adapted to support writing utensils, screwdrivers, and pliers, and also including a rectangular recessed area being adapted to support a drill said seat/tool-holding member further including an elongate slot being disposed intermediate of said seat portion and said tool support portion and being disposed through said top wall for being used as a handle for carrying said tool-holding stool device;

tray members being attached to said seat/tool-holding member, said tray members being integrally attached to sides of said tool support portion and being adapted to hold hardware including small parts and accessories;

leg members being attached to said seat/tool-holding member, said leg members being attached to an underside of said top wall and being angled relative to said top wall for stabilizing said tool-holding stool device; and wheel assemblies being attached to said leg members, said wheel assembly including wheel support brackets being rotatably mounted to bottom ends of said leg members, and also including wheels being rotatably mounted to said wheel support brackets, and further including wheel locking members being disposed in said wheel support brackets and being engagable to said wheels for preventing rotation of said wheels.

* * * * *